United States Patent [19]

Burpee

[11] 4,027,354

[45] June 7, 1977

[54] DETACHABLE WINDSHIELD WIPER ASSEMBLY FOR HELMET

[76] Inventor: Louis W. Burpee, Spencer Road, Whitefield, N.H. 03598

[22] Filed: Dec. 1, 1975

[21] Appl. No.: 636,819

[52] U.S. Cl. ..... 15/250.3; 2/438; 74/25; 351/158

[51] Int. Cl.[2] ..... B60S 1/24

[58] Field of Search ..... 15/250.29, 250.27, 250.3, 15/22 R, 22 A; 2/9, 438; 74/22 R, 23, 20, 25; 128/49; 351/158

[56] References Cited

UNITED STATES PATENTS

| | | | |
|---|---|---|---|
| 1,839,175 | 12/1931 | Hueber | 15/250.3 |
| 2,737,658 | 3/1956 | Poeder | 15/250.3 X |
| 2,888,703 | 6/1959 | Karwowska | 351/158 |
| 3,365,963 | 1/1968 | Happe | 15/22 R X |

FOREIGN PATENTS OR APPLICATIONS

| | | | |
|---|---|---|---|
| 795,771 | 1/1936 | France | 351/158 |
| 1,108,504 | 8/1955 | France | 15/250.3 |
| 690,598 | 6/1930 | France | 15/250.3 |
| 866,309 | 12/1976 | Germany | 15/250.3 |

*Primary Examiner*—Peter Feldman
*Attorney, Agent, or Firm*—Joel Halpern

[57] ABSTRACT

A detachable windshield wiper assembly for a helmet having a front visor consists of a housing which has fastening means cooperable with means on the helmet for detachably securing the housing thereto. The housing has a rear wall, which has the fastening means, contoured to be brought into close engagement with the front wall of the helmet. The housing carries within same an electric motor, gearing drivably connected to the motor, and an oscillatable wiper blade-carrying arm which extends through an opening in the lower portion of the housing. The wiper blade-carrying arm is connected to a pivotable element which is driven by the motor and gearing through an arc determinative of the sweep of the wiper blade.

9 Claims, 4 Drawing Figures

DETACHABLE WINDSHIELD WIPER ASSEMBLY FOR HELMET

BACKGROUND OF THE INVENTION

The present invention relates to windshield wiping apparatus and more particularly to a detachable windshield wiper assembly for a helmet having a front visor.

Windshield wipers for eyeglasses or goggles have been known heretofore. Such wiper assemblies have included a miniaturized motor, either electrical or mechanical, gearing, and a wiper arm operatively connected to the gearing. There has been need for a windshield wiping device for use with a helmet such as the safety helmet worn by a motorcyclist which can be fixedly secured from the helmet so that such device can be employed in association with the helmet only in times of inclement weather.

SUMMARY OF THE INVENTION

It is one object of this invention to provide a detachable windshield wiper assembly capable of use with a helmet having a front visor.

It is another object of the invention to provide a detachable windshield wiper assembly for the front visor of a helmet which is light weight and contains the operative components arranged in a compact manner whereby the device, when attached to the helmet, is efficient yet not cumbersome.

It is yet another object of the invention to prove a detachable windshield wiper assembly for the front visor of a helmet which utilizes a minimum of operational elements so as to reduce the size and cost of the device and also minimize maintenance thereof.

Other objects and advantages of the invention will become readily apparent from the following description of the invention.

According to the present invention there is provided a detachable windshield wiper assembly for a helmet having a front visor comprising:

- a housing including a rear wall adapted to be brought into detachable engagement with the front wall of a helmet, the rear housing wall having fastening means associated therewith for detachable connection with cooperable fastening means on the front wall of the helmet.
- motor means positioned within the housing including an output shaft;
- a worm gear carried by the output shaft of the motor means;
- a pinion mounted within the housing drivable by the worm gear;
- a pivotable element mounted within the housing and operatively connected to the pinion to be oscillated thereby through a predetermined arc;
- an oscillatable wiper arm connected to the pivotable element and projecting through an opening in a lower portion of the housing, the oscillatable wiper arm carrying thereon a windshield wiper blade;
- and means carried by the housing for selectively powering the motor means.

BRIEF DESCRIPTION OF THE DRAWINGS

In order that the invention may be more fully understood it will now be described, by way of example, with reference to the accompanying drawings in which.

DETAILED DESCRIPTION OF THE INVENTION

Figure 1:
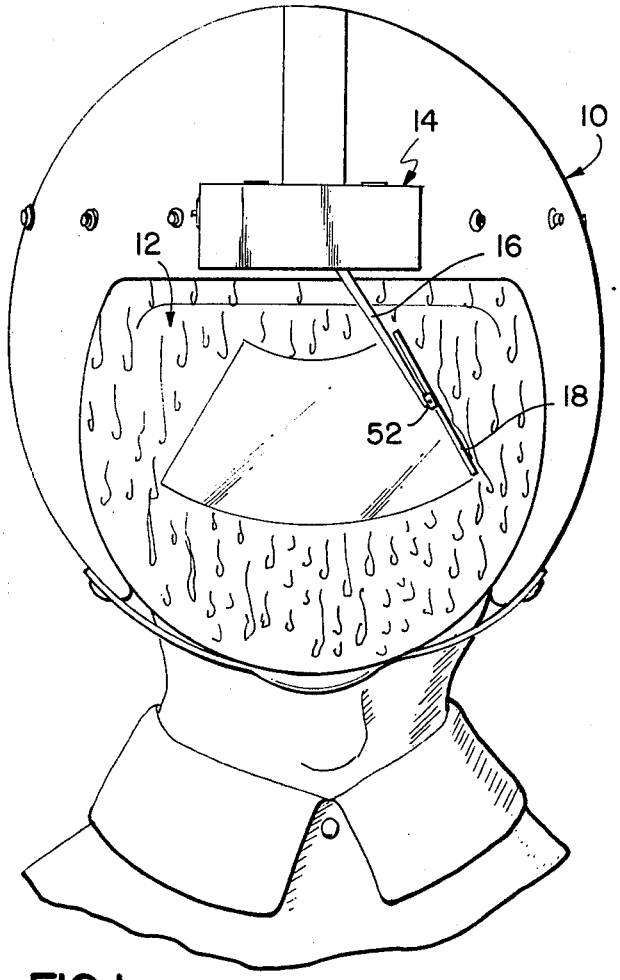
FIG. 1 is a front view of a person wearing a helmet to which is attached the windshield wiper assembly of the present invention.
Figure 2:
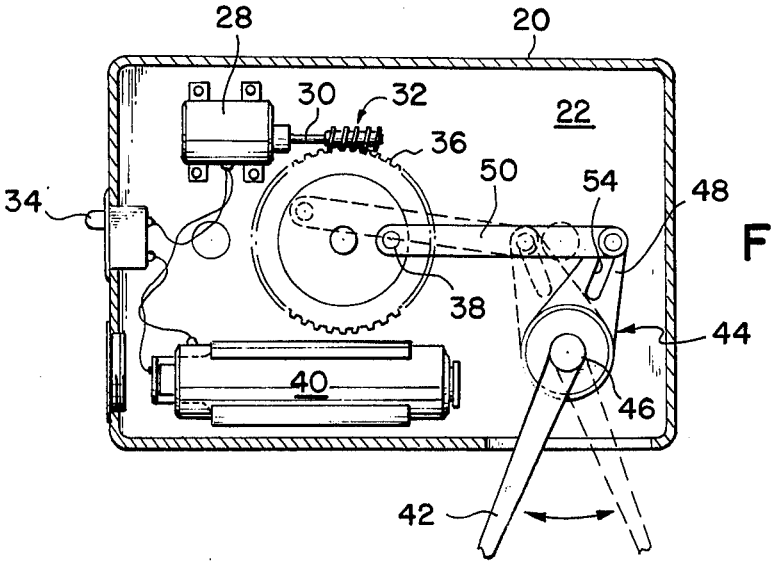
FIG. 2 is a front elevational view of the windshield wiper assembly of the present invention with the front wall of the housing removed therefrom.

Referring to FIGS. 1 and 2 of the drawings there is shown a helmet 10 which is of the type worn by motorcyclists and which includes a front visor or windshield 12 of a transparent material such as clear plastic. The helmet is shown as having detachably secured thereon a windshield wiper assembly designated generally by numeral 14. The wiper assembly includes a wiper arm 16 to which there is attached a wiper blade 18.

Figure 4:
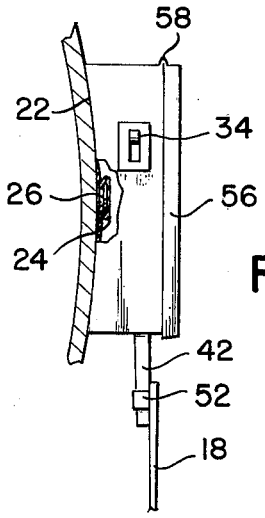
FIG. 4 is a side view of the assembly shown in FIG. 3 attached to a helmet.

The wiper assembly depicted in FIG. 2 shows a housing 20 which includes a rear wall 22 provided with fastening means 24 adapted to secure the housing to the front wall of the helmet which is provided with cooperable fastening elements 26. The rear wall of the housing is desirably contoured, as shown in FIG. 4, so as to have a generally concave surface which permits disposition of the wiper assembly device in close abutting relationship to the helmet. As shown in FIG. 1, the device is mounted immediately above the visor 12.

Within the housing 20 there is positioned motor means 28 having an output shaft 30 which carries a worm gear 32 thereon. As shown the motor is a miniaturized electric motor of any conventional type. It is selectively switched on and off by a switch 34 also mounted in the housing such as in a side wall thereof for easy manipulation. Powering motor 28 is a battery 40 which may be of the pen-light or flashlight type. It is operatively connected to motor 28 by means of switch 34. However, it is to be understood that the means for selectively powering the windshield wiper may constitute a mechanical motor such as a coiled spring and manually operable control means therefor.

A pinion 36 is rotatably mounted within the housing in such relation to the worm gear that it meshes therewith to be driven thereby when the motor is energized.

The pinion is provided with a radial pin 38 which rotates together with the pinion to effect the oscillation of a wiper arm 42 as thereafter described.

A pivotable element 44 is mounted within the housing and includes a shaft 46 which carries a radially extending lever arm 48. The pivotable element 44 is operatively connected to pinion 36 by means of a connecting rod 50. One end of the connecting rod is pivotably secured to the outer end of the radial lever arm whereas the other end of the connecting rod is pivotably secured to the radial pin 38. The lower portion of th pivotal element is provided with a depending wiper arm 42 which is desirably integral therewith such as by being constructed as an integral extension of the radial lever arm. The wiper arm may have a wiper blade 18 as an integral part thereof or, as is preferred, the wiper arm is provided with adapter means 52 adapted to detachably receive a wiper blade. In this manner the blade may be periodically replaced at a relatively small cost.

The pivotable element 44 may be constructed so as to provide for shaft 46 to be rotatably mounted in the housing in which event the radial lever arm is fixedly secured to the shaft. A guide slot 54 is formed in the radial lever arm to accommodate any linear motion which the end of the connecting rod may require during oscillation of the lever arm from a first position shown in solid lines in FIG. 2 to a second position as shown in dotted lines in FIG. 2.

Alternatively, the pivotable element 44 may be constructed such that shaft 46 is carried non-rotably in housing 20 in which event the radial lever arm is mounted loosely on the shaft or stud 46 so as to permit its oscillation by connecting rod 50 in response to rotation of the pinion.

Figure 3:
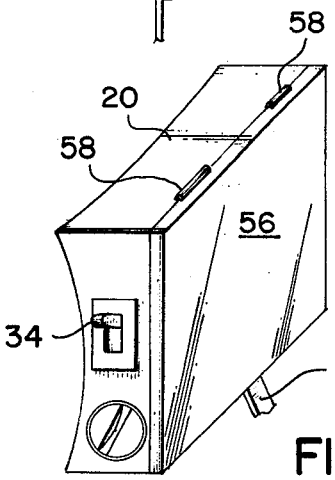
FIG. 3 is a perspective view of one form of the windshield wiper assembly of the invention within a housing therefor.

As shown in FIGS. 3 and 4 the housing may be formed with a front wall 56 which is hingedly connected as by hinges 58 to the housing so as to provide ready access to the interior of the housing for replacement of the battery or for other maintenance or adjustment purposes. It will be appreciated, of course, that access to the interior of the housing may be provided by any other suitable expedient. Another construction may include the provision of an access cover which can be snapped into place. As will also be recognized, the access cover need not be coextensive with the front wall portion of the housing but may occupy only a segment of same.

It will thus be seen that a detachable windshield wiper assembly for the front visor of a helmet has been provided which is relatively light-weight and compact and which relies upon the employment of a minimum of operational components. Such a device, having use with helmets worn by drivers of various types of vehicles, increases the safety factor in the operation of such vehicles during inclement weather. It is also contemplated that such a device posseses utility with crash helmets worn by drivers of sulkies (harness horse drivers) and even by jockeys of thoroughbred horses in view of the extremely compact and reliable nature of the device.

What is claimed is:

1. A detachable windshield wiper assembly for a helmet having a front visor comprising:

a housing including a rear wall contoured so as to be brought into detachable close engagement with the front wall of a helmet, said rear housing wall having fastening means associated therewith for detachable connection with cooperable fastening means on the front wall of the helmet;

motor means positioned within said housing including an output shaft;

a worm gear carried by the output shaft of said motor means;

a pinion mounted within said housing drivable by said worm gear;

a pivotable element mounted within said housing including a shaft and a radially extending lever arm carried thereon having a radially extending elongated slot therein, said pivotable element being drivable by said pinion to be oscillated thereby through a predetermined arc;

a connecting rod pivotably connected at one end thereof to said pinion and at the other end thereof to said lever arm so as to slide within said slot;

an oscillatable wiper arm connected integrally to said pivotable element and projecting through an opening in a lower portion of said housing, said oscillatable wiper arm carrying thereon a windshield wiper blade;

and means carried by said housing for selectively powering said motor means.

2. A detachable windshield wiper assembly according to claim 1, wherein said pivotable element includes a shaft mounted rotatably in said housing, said radially extending lever arm carried fixedly by said shaft.

3. A detachable windshield wiper assembly according to claim 1, wherein said pivotable element includes a shaft mounted in said housing, said radially extending lever arm carried by said shaft for oscillating movement thereon.

4. A detachable windshield wiper assembly according to claim 2, wherein said oscillatable wiper arm is integral with said lever arm.

5. A detachable windshield wiper assembly according to claim 3, wherein said oscillatable wiper arm is integral with said lever arm.

6. A detachable windshield wiper assembly according to claim 1, wherein said means for selectively powering said motor means includes a battery mounted within said housing and switch means operatively connecting said battery and motor means.

7. A detachable windshield wiper assembly according to claim 2, wherein a radial pin is provided on said pinion at a predetermined radial location thereof and said other end of said connecting rod is pivotably carried by said radial pin.

8. A detachable windshield wiper assembly according to claim 3, wherein a radial pin is provided on said pinion at a predetermined radial location thereof and said other end of said connecting rod is pivotably carried by said radial pin.

9. A detachable windshield wiper assembly according to claim 1, wherein said rear wall of the housing is provided with a concave contour to permit close engagement with the front wall of said helmet.

* * * * *